US007073255B1

(12) United States Patent
Swanson et al.

(10) Patent No.: US 7,073,255 B1
(45) Date of Patent: Jul. 11, 2006

(54) METHOD FOR PRODUCING RIBBON CABLE USING FLASH CURING

(75) Inventors: John Swanson, Portland, OR (US); James Pylant, Lake Oswego, OR (US); Ky Huynh, Tigard, OR (US)

(73) Assignee: Advanced Neuromodulation Systems, Inc., Plano, TX (US)

( * ) Notice: Subject to any disclaimer, the term of this patent is extended or adjusted under 35 U.S.C. 154(b) by 0 days.

(21) Appl. No.: 10/899,328

(22) Filed: Jul. 26, 2004

Related U.S. Application Data

(60) Continuation of application No. 10/347,035, filed on Jan. 17, 2003, now Pat. No. 6,766,578, which is a division of application No. 09/619,121, filed on Jul. 19, 2000, now abandoned.

(51) Int. Cl.
*H01R 43/00* (2006.01)

(52) U.S. Cl. ..... 29/868; 29/825; 29/828; 29/877; 29/755; 156/52; 174/107

(58) Field of Classification Search ..... 29/825, 29/866–868, 877, 828; 156/52, 269; 174/117 F, 174/107, 110 R; 228/180.21, 180.22
See application file for complete search history.

(56) References Cited

U.S. PATENT DOCUMENTS 4,381,208 A * 4/1983 Baverstock ..... 156/52
4,473,716 A * 9/1984 Jesseman ..... 174/117 F
4,691,418 A * 9/1987 Ingle et al. ..... 29/25.35
4,780,157 A * 10/1988 Coon ..... 156/53
4,870,752 A * 10/1989 Brown et al. ..... 29/866
4,888,071 A * 12/1989 Kauffman et al. ..... 156/50

* cited by examiner

*Primary Examiner*—Minh Trinh
(74) *Attorney, Agent, or Firm*—Law Office of Timothy E. Siegel; Timothy E. Siegel

(57) ABSTRACT

A method of manufacturing a ribbon cable, comprising providing a set of insulated wires and aligning said insulated wires in a predetermined arrangement. The insulated wires are warmed sufficiently for said insulation to be become soft and adhesive, are pressed together so that they adhere to one another and allowed to cool, to form a ribbon cable.

6 Claims, 6 Drawing Sheets

METHOD FOR PRODUCING RIBBON CABLE USING FLASH CURING

RELATED APPLICATIONS

The present application is a continuation of U.S. application Ser. No. 10/347,035 filed Jan. 17, 2003 now U.S. Pat. No. 6,766,578 which is a divisional of U.S. application Ser. No. 09/619,121 filed Jul. 19, 2000 now abandoned.

BACKGROUND OF THE INVENTION

The present invention relates to ribbon cable and a method of manufacturing the same.

At present, ribbon cable is typically produced by setting wires into a molten or partially molten resin and extruding the resultant combination as the resin cools. FIG. 1 shows a greatly expanded cross-sectional view of a prior art ribbon cable 2 constructed according to this method. A set of wires 4 are set into a resin coating 6. Note the misalignment of the wires 4, with some pairs of wires 4 being closer together than others and some wires 4 being at a different vertical level. This manufacturing procedure is perfectly adequate for most of the purposes for which ribbon cable is used. There are some applications, however, for which the availability of ribbon cable having more precisely positioned wires would be greatly beneficial.

In some biomedical equipment applications it is necessary to connect each wire of a ribbon cable to a contact pad on a flex circuit. If the wires of the ribbon cable are not precisely aligned, at least one of them might not be able to contact its corresponding contact pad. Currently, manufacturers know how to produce precisely aligned extruded ribbon cables having a dielectric coating of thermoplastic fluoropolymer, tetrafluoroethylene ("TFE," most commonly marketed under the TEFLON® trademark) being the most well known. Thermoplastic fluoropolymers tend to be relatively hard materials that are difficult to remove using an ND:YAG laser (typically for the purpose of stripping the wires) than are some other dielectric materials such as polyurethane or polyimide. Moreover, the production of extruded, precisely aligned fluoropolymer ribbon cable requires precise adjustments, resulting in an expensive end product. Unfortunately, when a similar extrusion technique is used with polyurethane or polyimide, the product curls up as it comes out of the extruder. Accordingly, it is desirable to broaden the range of dielectric coatings that can be used to produce ribbon cables beyond those that can be made into an extrudable solution, plasma coating or powder coating.

It is also desirable to have accurately and uniformly positioned wires in a ribbon cable for the case in which a stack of ribbon cables must be threaded through a fixed size aperture. This situation occurs in the biomedical field in which tolerances for the transmission of signals within a particular spacing can be very tight. If the wires extend in a straight line in each cable, the cables may be stacked in a more compact form, with the ridges of a first ribbon cable fitting into the valleys of a second ribbon cable.

SUMMARY

In a first separate aspect the present invention is a method of manufacturing a ribbon cable, comprising providing a set of insulated wires and aligning said insulated wires in a predetermined arrangement. The insulated wires are warmed sufficiently for said insulation to become soft and adhesive, are pressed together so that they adhere to one another and allowed to cool, to form a ribbon cable.

In a second separate aspect, the present invention is an apparatus for manufacturing a ribbon cable having precisely placed wires, comprising a guide path assembly adapted to draw a set of insulated wires along a predetermined path, at least one heater along said predetermined path, adapted to warm said insulation of said insulated wires until it is soft and adhesive and to press said insulated wires into one another.

In a third separate aspect, the present invention is a ribbon cable comprising a set of wires that are aligned to an accuracy of 10 μm and wherein said wires are set into a layer of dielectric material that is softer than tetrafluoroethylene.

In a fourth separate aspect, the present invention is a method of producing a ribbon cable comprising the steps of paying out a set of wires, under substantially their maximum bearable tension, through precise place determiners, into a curable resin to form a resin/wire mix and flash curing the resin directly after the resin/wire mix exits the precise place determiners.

The foregoing and other objectives, features and advantages of the invention will be more readily understood upon consideration of the following detailed description of the preferred embodiment(s), taken in conjunction with the accompanying drawings.

DETAILED DESCRIPTION OF THE PREFERRED EMBODIMENTS

Figure 1:
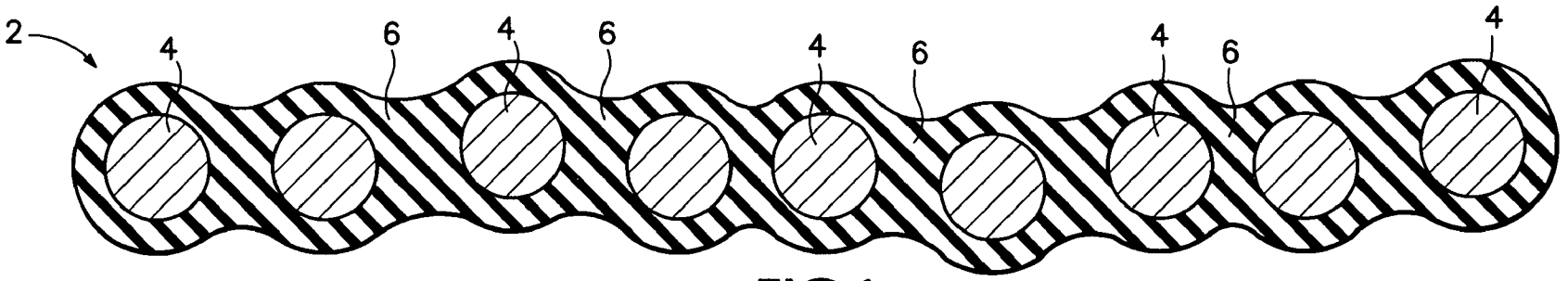
FIG.1 PRIOR ART
FIG. 1 is a greatly expanded cross-sectional view of a prior art ribbon cable.

A ribbon cable production assembly 10 includes a pay off wire guide assembly 12 having a pair of rollers 14. A set of insulated wires 16 is threaded through the pay off wire guide assembly 12 and from there travels through a comb assembly 18, having a set of precise place determiners 19 that ensure that each wire of set 16 maintains its position relative to the other wires of set 16. After this the wires 16 travel through a heater assembly 30 having two heated, grooved rollers 32, and a proximity heater 36. Rollers 32 both guide and heat wires 16. Heater 36 on the other hand does not touch wires 16 but merely warms them with its radiant heat.

Each insulated wire 16 has a conductive core 20 bearing an inner layer 22 of insulation and an outer layer 24 of insulation. Each inner layer 22 is made of polyurethane or polyimide and each outer layer 24 is a thin, heat sealable layer of nylon material 24. The nylon outer layer 24 has a melting point of approximately 174° C. (310° F.). Polyimide has a melting point that is considerably higher than that of nylon. As a result, the nylon outer layer 24 softens at the temperature of the rollers, but the polyimide inner coating is left unchanged by the heat. More specifically the exterior surfaces of rollers 32 are controlled to stay at about 174° C. (310° F.), preferably by a PID controller (informed by a temperature measurement device [not shown]), so that they soften the nylon layer 24 as it touches this surface. The softened nylon layers 24 of neighboring insulated wires 16 adhere to one another, thereby forming a ribbon cable out of the individual insulated wires 16. Wire with dual, concentric coatings of polyimide and nylon can be made to order by Rea Wire of Fort Wayne, Ind.

Figure 4:
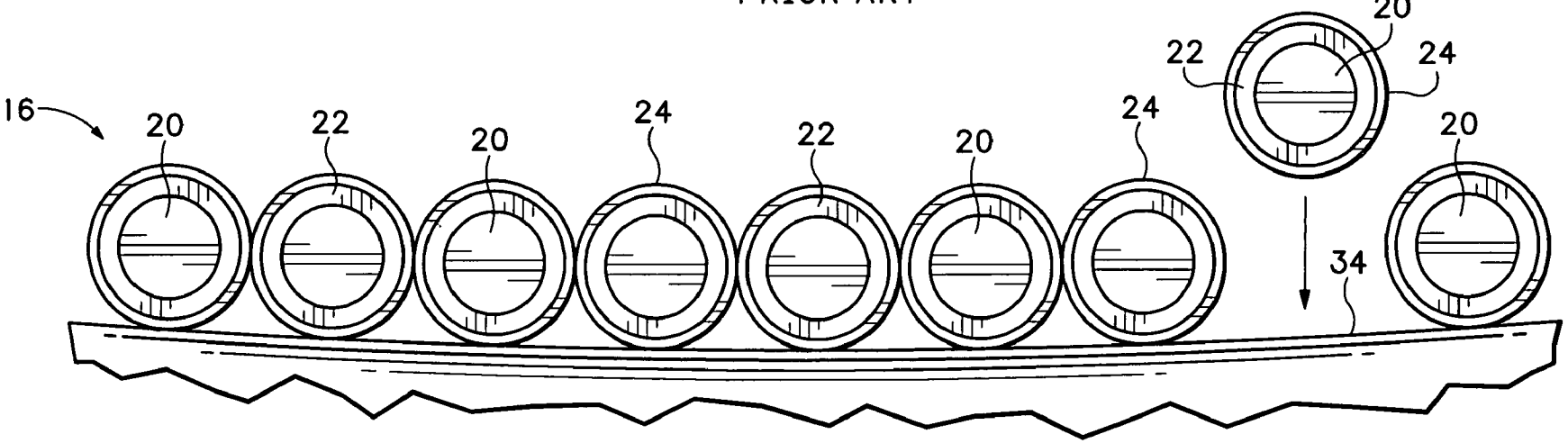
FIG. 4 is a greatly expanded view of a roller groove of the apparatus of FIG. 2, accommodating insulated wires, according to the method of the present invention.

Each roller 32 has a set of grooves or troughs 34. All of the insulated wires 16 are brought together into a single groove 34 of rollers 32 and are heated and gently pushed together in the single groove 34. In one preferred embodiment each groove 34 has a different radius of curvature, so that various gauge wires can be accommodated. For insulated wires 16 each having a nominal outer radius of 36.75 μm (1.5 mils), a groove having a radius of curvature of 1 mm works well. FIG. 4 shows the very bottom of a groove 34 filled with wires 16 for this case. It may be noted that even though a 1 mm radius of curvature may sound like a narrow groove to those unfamiliar with the scale used for ribbon cable of this sort, it is not only ample to accommodate the wires 16 but also represents such a gradual curve that no cross-sectional curvature is imparted to the ribbon cable produced. In another note, it has been found that a wire speed of about 1 inch per second produces a sound product.

Rollers 32 each have an exterior covering of nonstick material, such as tetrafluoroethylene (most commonly sold under the trademark TEFLON®). This prevents any insulated wire 16 from sticking to a portion of the roller and thereby failing to move into contact with the other wires 16.

Next, insulated wires 16 pass through a dancer assembly 40, which measures the tension on wires 16, so that this information can be used to control a take up assembly 50, to keep the wires under a constant, acceptable level of tension. Dancer assembly 40 works by passing the wires 16 over a first guide wheel 42, under a dancer wheel 44 (blocked from view in FIG. 2) and over a second guide wheel 46. The dancer wheel 44 is urged downwardly and to the side by a spring so that its position is dependent on the tension in wires 16, which pull the other way. The final result of this entire process is a finished ribbon cable 52.

Figure 6:
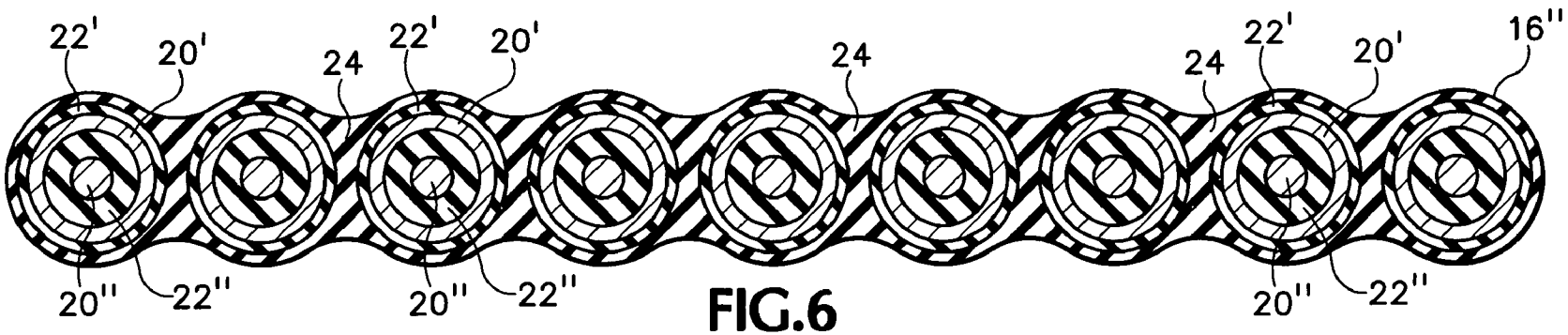
FIG. 6 is a greatly expanded cross-sectional view of a ribbon cable made up of a set of coaxial cables according to an alternative preferred embodiment of the present invention.

In one preferred embodiment the insulated wires 16 are gauge 50 AW wires having a nominal outer diameter of 36.75 μm (1.5 mils), so that if 8 wires were used the total width of the ribbon cable would be about 294 μm (12 mils). Wires 16 may be made of the copper alloy that goes by the industry standard designation of CA-108. It should be noted that the example of an 8-wire ribbon cable is used merely for ease of explanation. A more typical number of wires would be 32, although there is no maximum or minimum number of wires that must be used. One preferred embodiment includes at least one wire 16' that has a core 20' made of a high tensile strength material such as high tensile strength steel and is not used for conducting electricity but instead is used to impart strength to the overall ribbon cable 52. There are many operations where it is necessary to direct a ribbon cable 52 by pulling it or otherwise handling the ribbon cable 52. The physical strength imparted by a wire having high tensile strength facilitates this type of operation. In an alternative preferred as shown in FIG. 6, a set of coax cables, 16' and having an outer dielectric layer 22', an outer conductive layer 20', an inner dielectric layer 22" and an inner conductor 20".

Figure 2:
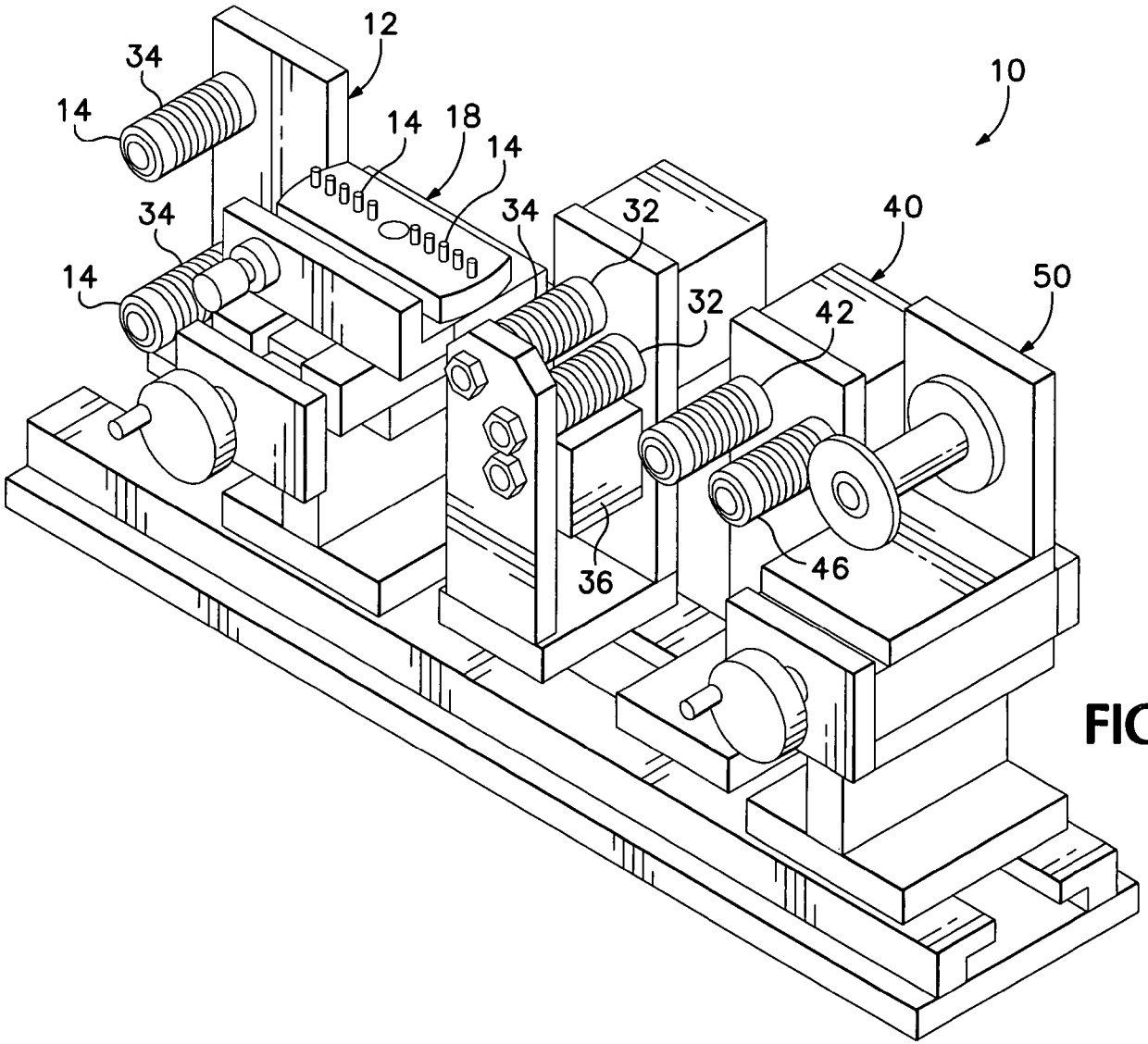
FIG. 2 is a perspective view of an apparatus for producing ribbon cable according to the present invention.
Figure 3:
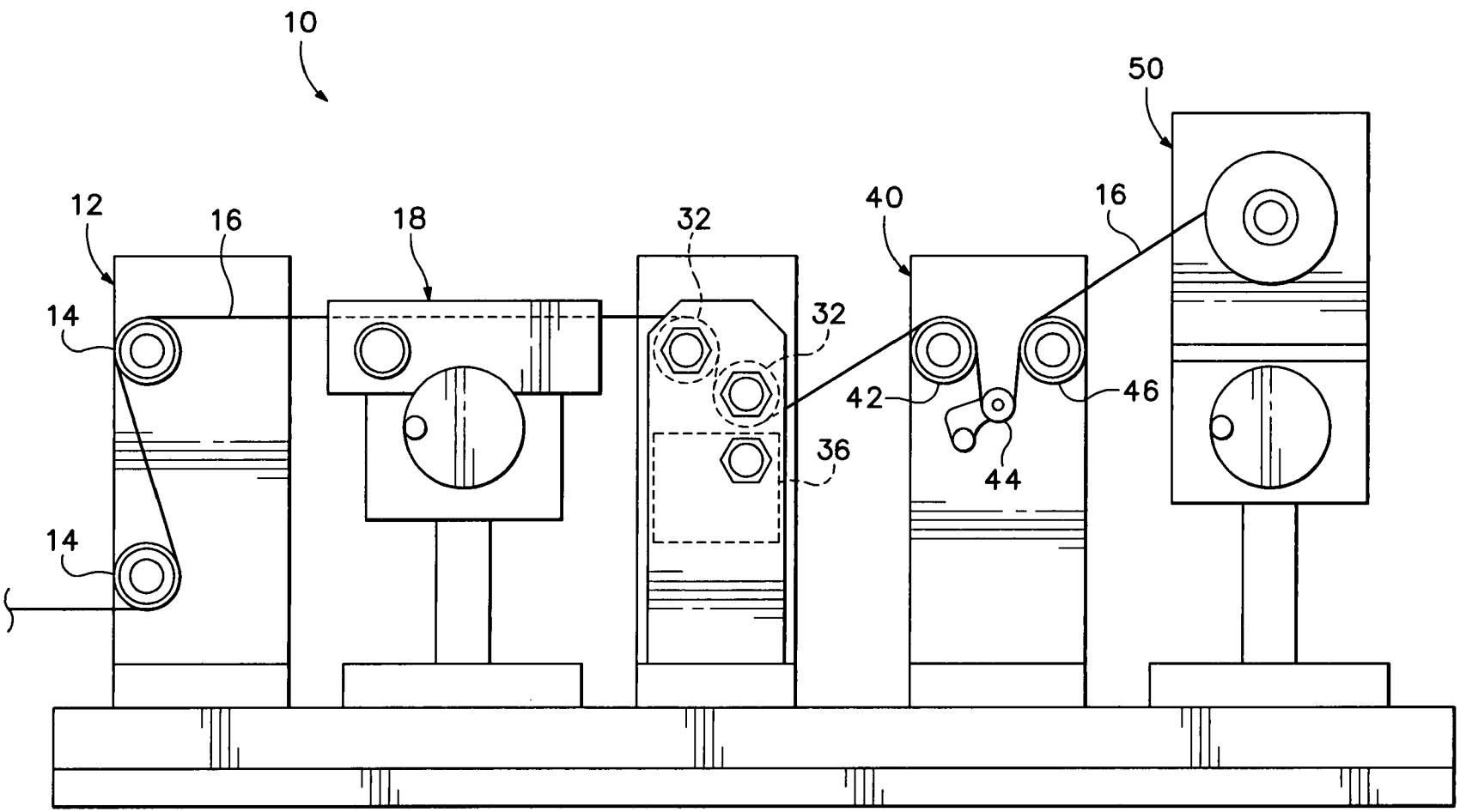
FIG. 3 is a side view of the apparatus of FIG. 2.
Figure 5:
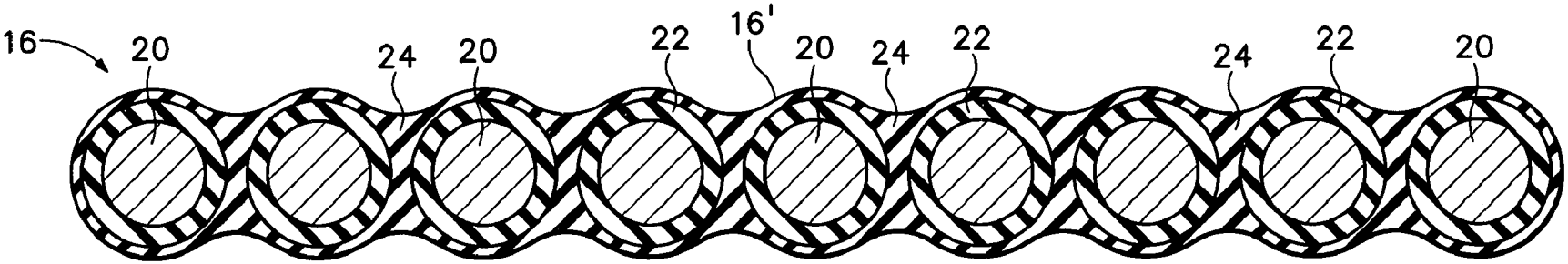
FIG. 5 is a greatly expanded cross-sectional view of a ribbon cable according to the present invention.
Figure 7:
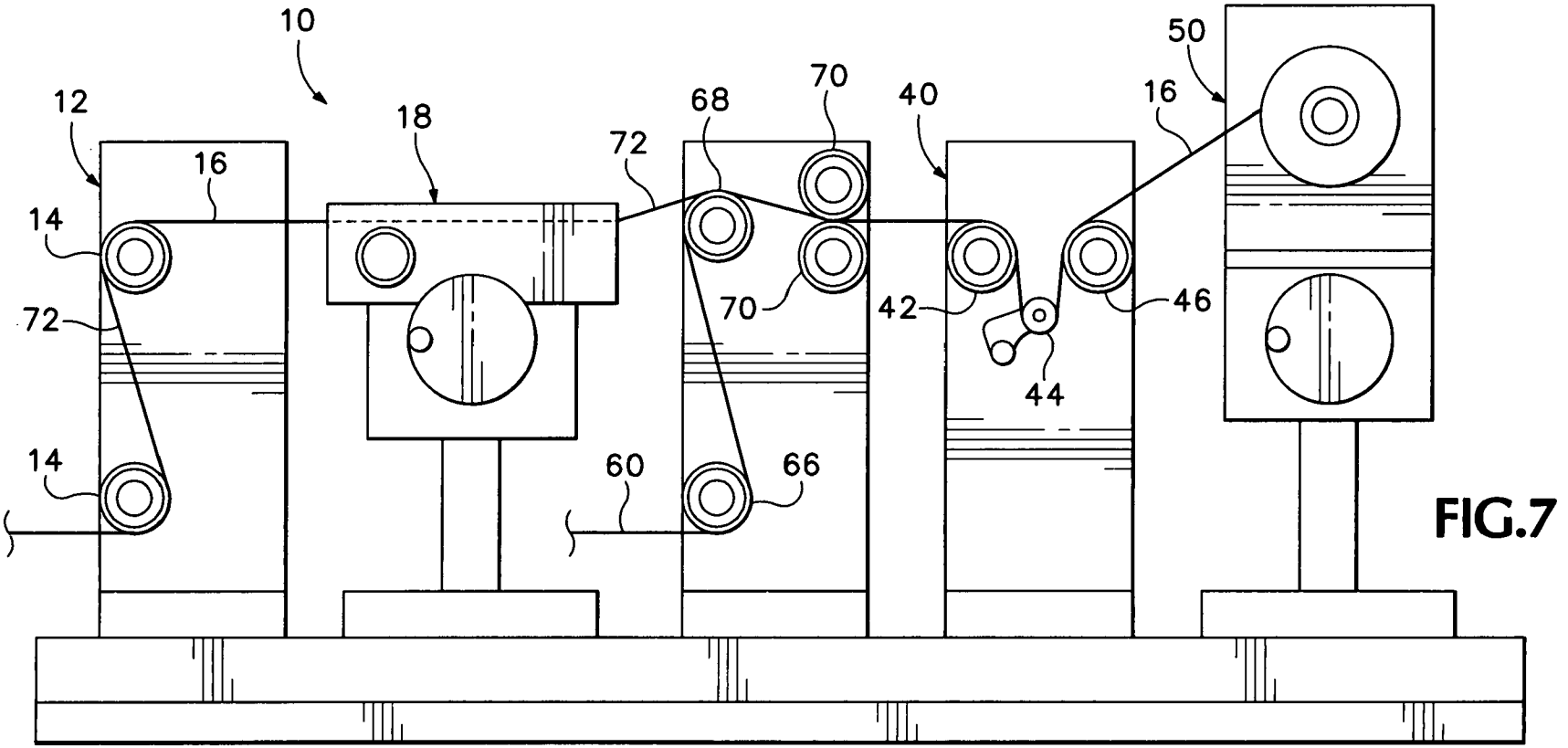
FIG. 7 is a side view of an alternative apparatus for producing ribbon cable according to the present invention.
Figure 8:
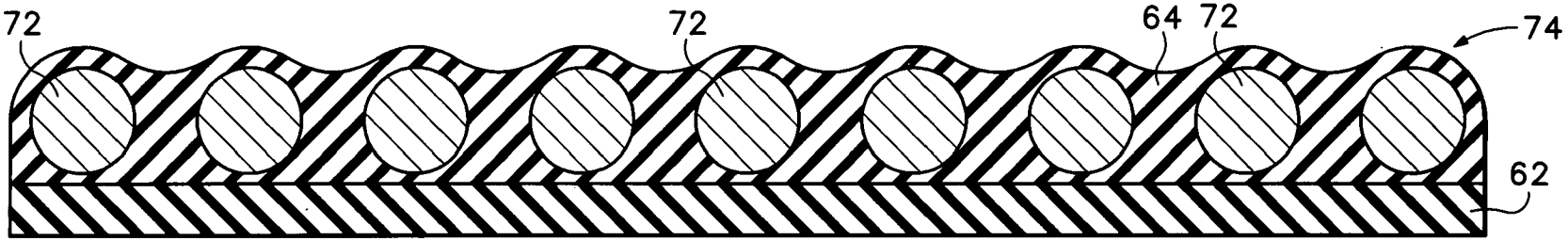
FIG. 8 is a greatly expanded cross-sectional view of an alternative embodiment of a ribbon cable.

A first alternative preferred embodiment is shown in FIGS. 7 and 8. In FIG. 7 features that are identical to features in FIGS. 2 and 3 are given the same reference numbers. A tape 60 having a backing 62 (FIG. 8) of Kapton® or liquid crystal polymer and a face 64 (FIG. 8) of nylon or a similar polyethylene is fed past a payout roller 66 and past a heated roller 68, where the face 64 is melted and wires 72 (the same as wire cores 20 but initially without the dielectric layers 22 and 24) are accepted into the molten face 64 of tape 60 and further pressed together by TFE coated nip rollers 70, to form a completed ribbon cable 74 (FIG. 8). In a variant of the first preferred embodiment, comb assembly 18 is moved as close as possible to heated roller 68. To achieve this end, different styles of comb assemblies may be used, for example, ones having less of a range of adjustment than comb assembly 18 and which, accordingly, could be positioned far closer to heated roller 68.

Figure 9:
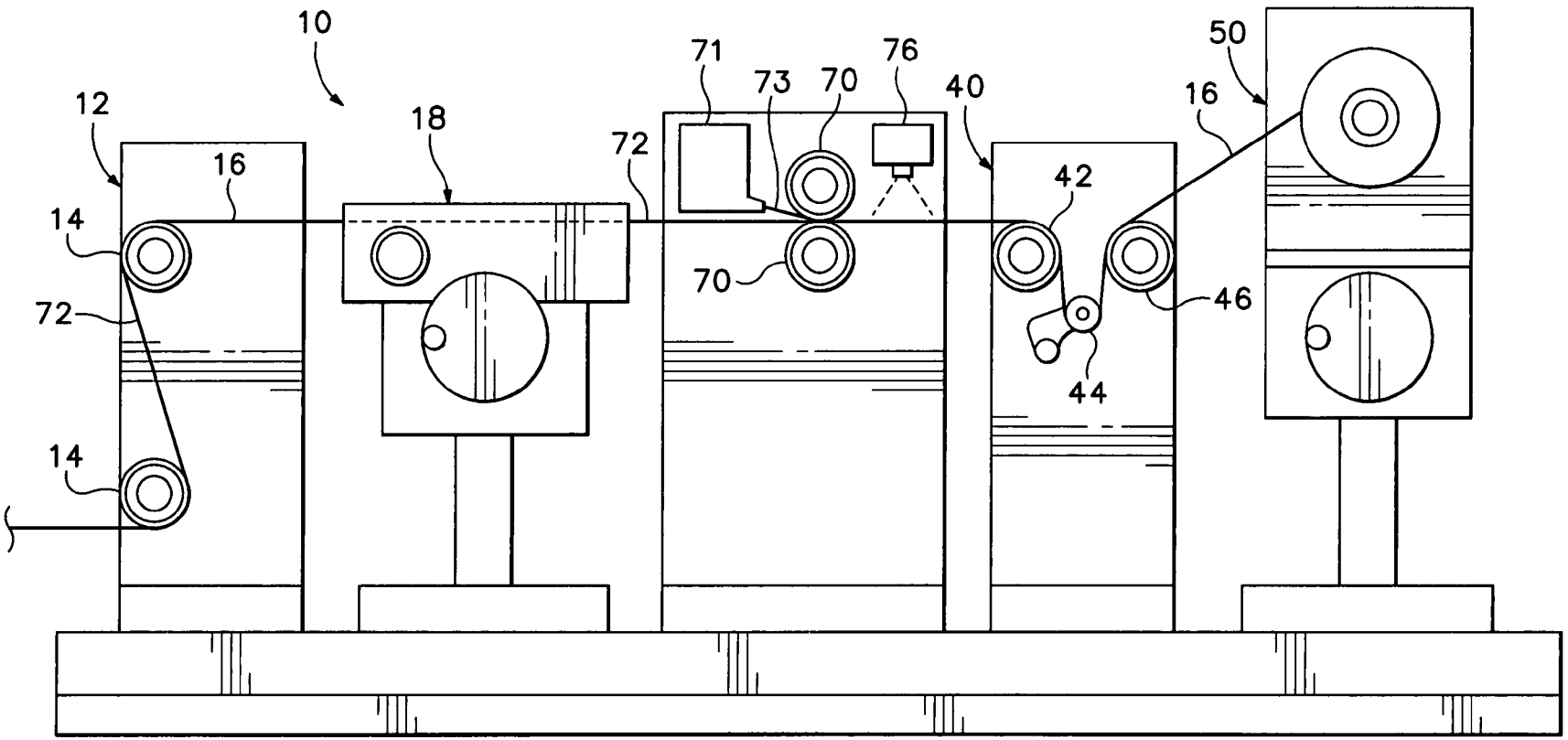
FIG. 9 is a side view of an additional alternative apparatus for producing ribbon cable according to the present invention.

A second alternative preferred embodiment is shown in FIG. 9. In this embodiment, an extruder 71 places molten dielectric extrudate 73 atop wires 72. The wires and the extrudate 73 are pressed together by nip rollers 70 and flash cured by UV light source 76. In the lexicography of this patent, this is considered to be directly after the resin/wire mix leaves the precise place determiners 19. In a variant, there is no UV light source 76 and extrudate 73 and nip rollers 70 are heated to cure extrudate 73. In this embodiment, and the first alternative preferred embodiment, wires 72 are maintained at close to their maximum bearable tension, in order to maintain them in an extremely straight and unwavering alignment. In a variant of the second alternative embodiment UV source 76 is placed upstream (to the left of [in FIG. 9]) of nip rollers 70 so that the extrudate 73 can be cured as soon as it joins with the wires 72. Similar to the variant of the first preferred embodiment, extruder 71 may also be moved as close as possible to comb 18, to help ensure proper spacing of wires 72. In this manner the extrudate is cured directly after leaving the precise place positioners 19 of comb assembly 18. In another variant, the wires 72 pass through the extruder 71 and a set of precise place determiners are positioned where the wires 72 exit extruder 71.

The terms and expressions which have been employed in the foregoing specification are used as terms of description and not of limitation, and there is no intention, in the use of such terms and expressions, of excluding equivalents of the features shown and described or portions thereof, it being recognized that the scope of the invention is defined and limited only by the claims which follow.

The invention claimed is:

1. A method of producing a ribbon cable comprising the steps of:

a) providing a set of wires;

b) extruding a curable resin;

c paying out said wires, under substantially their maximum bearable tension, through precise place determiners, into the curable resin to form a resin/wire mix; and d flash curing said resin directly after said resin/wire mix leaves said precise place determiners.

2. The method of claim 1 wherein said curable resin is held in place on a backing tape and wherein said curable resin together with said backing tape forms an adhesive tape.

3. The method of claim 1 wherein said curable resin is extruded past said precise place determiners with said wires.

4. The method of claim 1 wherein said resin is flash cured through the application of heat.

5. The method of claim 1 wherein said resin is flash cured through the application of light.

6. The method of claim 5 wherein said light is ultraviolet light.

* * * * *